US011105287B1

(12) United States Patent
Glugla et al.

(10) Patent No.: US 11,105,287 B1
(45) Date of Patent: Aug. 31, 2021

(54) METHODS AND SYSTEM FOR STOPPING AN ENGINE

(71) Applicant: Ford Global Technologies, LLC, Dearborn, MI (US)

(72) Inventors: Chris Glugla, Macomb, MI (US); Brad VanDerWege, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/992,416

(22) Filed: Aug. 13, 2020

(51) Int. Cl.
*F02D 41/04* (2006.01)
*F02D 41/00* (2006.01)

(52) U.S. Cl.
CPC ..... *F02D 41/042* (2013.01); *F02D 41/0002* (2013.01); *F02D 2041/0095* (2013.01)

(58) Field of Classification Search
CPC ..... F02D 41/042; F02D 41/0002; F02D 2041/0095
See application file for complete search history.

(56) References Cited

U.S. PATENT DOCUMENTS

| | | | | |
|---|---|---|---|---|
| 6,116,207 | A | 9/2000 | Firey | |
| 7,441,541 | B2 | 10/2008 | Nakamura et al. | |
| 8,663,051 | B2 | 3/2014 | Sten | |
| 9,261,040 | B2 * | 2/2016 | Gibson | F02D 41/126 |
| 2010/0204902 | A1 * | 8/2010 | Kuroki | F02D 41/065 701/103 |

* cited by examiner

*Primary Examiner* — Xiao En Mo
(74) *Attorney, Agent, or Firm* — Geoffrey Brumbaugh; McCoy Russell LLP

(57) ABSTRACT

Systems and methods for stopping and starting a direct injection engine are described. In one example, the air is injected into one or more pre-chambers of engine cylinders to adjust engine pumping torque during an engine stop so that the engine may stop at a crankshaft position that facilitates direct engine starting.

20 Claims, 4 Drawing Sheets

METHODS AND SYSTEM FOR STOPPING AN ENGINE

FIELD

The present description relates to methods and a system for stopping rotation of an engine at a desired stopping position. The methods and systems may be particularly useful for vehicles that may be directly started.

BACKGROUND AND SUMMARY

A vehicle may be directly started via igniting a mixture of air and fuel that is in a cylinder when rotation of an engine is stopped. However, to ensure direct starting is possible and efficient, it may be desirable to stop the engine at a particular crankshaft position. For example, it may be desirable to stop an engine when one engine cylinder is within a predetermined crankshaft angular distance from top-dead-center of the cylinder's expansion stroke. By stopping the engine at a desired crankshaft position, it may be possible to improve the possibility of enabling the engine to directly start during a subsequent engine start. One way to stop an engine at a particular crankshaft angle is to open and close an engine throttle after fuel delivery to the engine has ceased during an engine stopping sequence. However, it may be challenging to get the engine to stop consistently at a desired crankshaft position because the amount of air that is let into engine cylinders via the throttle may be difficult to reliably control due to intake manifold filling dynamics. Therefore, it may be desirable to provide a way of stopping an engine at a desired crankshaft angle that relies less on controlling the engine's throttle.

The inventors herein have recognized the above-mentioned issues and have developed a method for operating an engine, comprising: injecting air into a pre-chamber of a cylinder via a controller in response to a request to stop rotation of the engine.

By injecting air into a pre-chamber of a cylinder in response to an engine stop request, it may be possible to provide the technical result of improved engine stopping. In particular, it may be possible to more reliably stop an engine at a crankshaft position that improves the possibility of directly starting the engine during a subsequent engine restart. For example, air may be injected to a pre-chamber of a cylinder that is on its compression stroke so that the mass of air in the cylinder increases. By increasing the amount of air in the cylinder during the cylinder's compression stroke, engine speed may be reduced sooner so that the engine may stop at a particular crankshaft angle that may be conducive for direct engine starting.

The present description may provide several advantages. In particular, the approach may improve engine stop position control. In addition, the approach may improve direct engine starting by stopping the engine at a position that is more favorable to direct starting. Further, the approach may allow air to be injected to two cylinders during engine stopping to provide additional flexibility.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

The present description is related to improving stopping of an engine. The engine may be stopped at a desired crankshaft position so that the engine may be directly started to reduce reliance on starting the engine via an electric machine. The engine may be of the type shown in FIG. 1 and the engine may include a pre-chamber as shown in detail in FIG. 2. The pre-chamber may make it possible to increase torque needed to rotate the engine by allowing air to enter a cylinder after the cylinder's intake valves have closed and before the cylinder's exhaust valves open during a cycle of the cylinder. The increased torque to rotate the engine may permit more precise engine stopping control. Two example engine stopping sequences are shown in FIG. 3. The engine stopping sequences of FIG. 3 may be provided via the method of FIG. 4 and the system of FIGS. 1 and 2.

Figure 1:
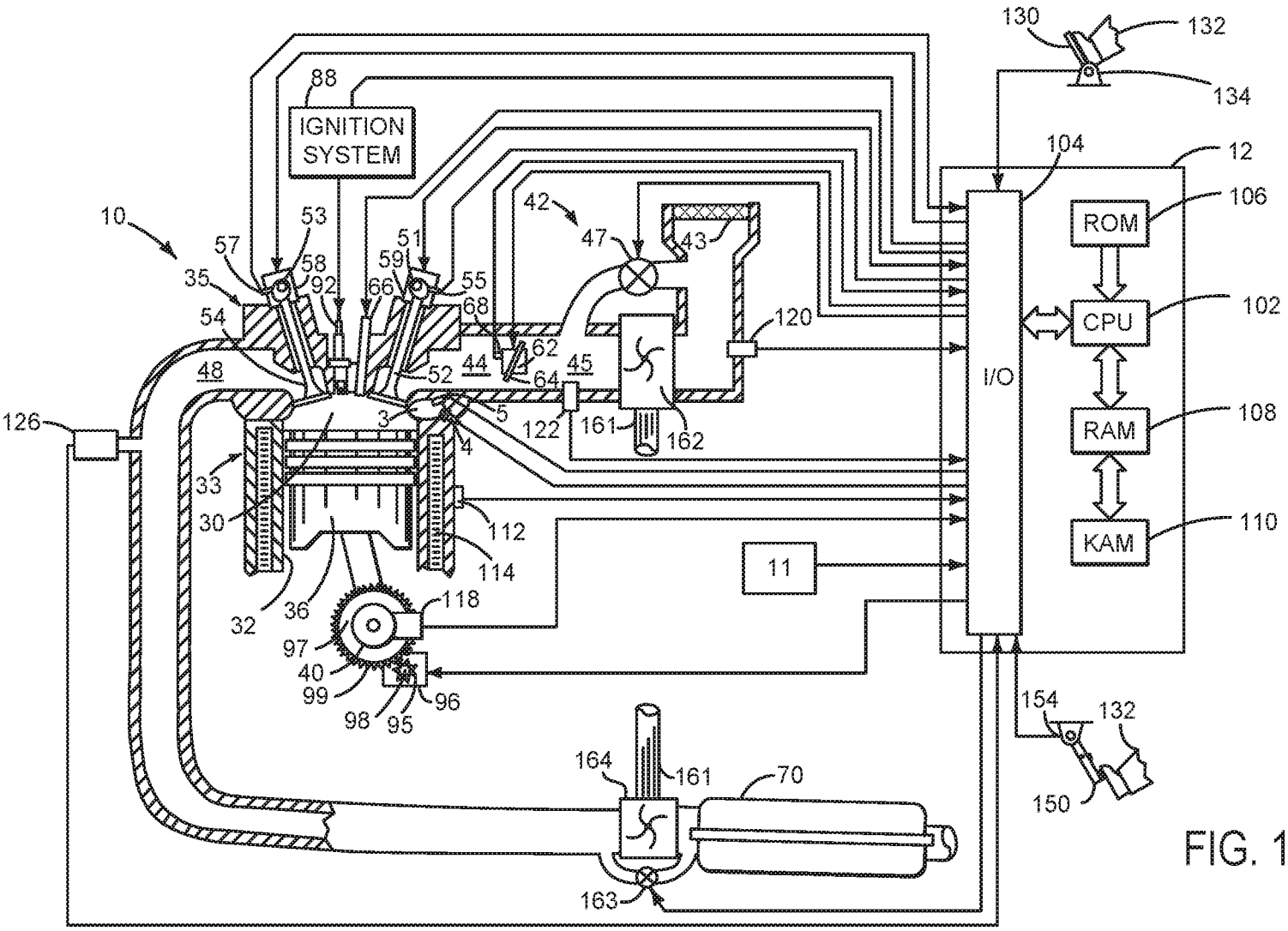
FIG. 1 is a schematic diagram of an engine.

Referring to FIG. 1, internal combustion engine 10, comprising a plurality of cylinders, one cylinder of which is shown in FIG. 1, is controlled by electronic engine controller 12. The controller 12 receives signals from the various sensors shown in FIGS. 1 and 2. The controller may employ the actuators shown in FIGS. 1 and 2 to adjust engine operation based on the received signals and instructions stored in memory of controller 12.

Engine 10 is comprised of cylinder head 35 and block 33, which include combustion chamber 30 and cylinder walls 32. Combustion chamber 30 may alternatively be referred to as a cylinder. Piston 36 is positioned therein and reciprocates via a connection to crankshaft 40. Flywheel 97 and ring gear 99 are coupled to crankshaft 40. Optional starter 96 (e.g., low voltage (operated with less than 30 volts) electric machine) includes pinion shaft 98 and pinion gear 95. Pinion shaft 98 may selectively advance pinion gear 95 to engage ring gear 99 and crankshaft 40. Ring gear 99 is directly coupled to crankshaft 40. Starter 96 may be directly mounted to the front of the engine or the rear of the engine. In some examples, starter 96 may selectively supply torque to crankshaft 40 via a belt or chain. In one example, starter 96 is in a base state when it is not engaged to the engine crankshaft 40.

Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation device 59. Exhaust valve 54 may be selectively activated and deactivated by valve activation device 58. The intake and exhaust valves may be deactivated in a closed position so that the intake and exhaust valves do not open during a cycle of the engine (e.g., four strokes). Valve activation devices 58 and 59 may be electro-mechanical devices.

Pre-chamber 3 is shown external to and coupled to combustion chamber 30 and it may receive fuel via pre-chamber fuel injector 4. Pre-chamber 3 also includes a spark plug 5 for generating spark and combusting air-fuel mixtures formed in pre-chamber 3. In some examples, pre-chamber 3 may be incorporated into cylinder head 35. Air may also be injected into pre-chamber 3 via an injector as shown in greater detail in FIG. 2.

Fuel injector 66 is shown protruding into combustion chamber 30 and it is positioned to inject fuel directly into cylinder 30, which is known to those skilled in the art as direct injection. Fuel injector 66 delivers liquid fuel in proportion to the pulse width from controller 12. Fuel is delivered to fuel injector 66 by a fuel system (not shown) including a fuel tank, fuel pump, and fuel rail (not shown). In one example, a high pressure, dual stage, fuel system may be used to generate higher fuel pressures.

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a propulsive force pedal 130 for sensing force applied by human driver 132; a position sensor 154 coupled to brake pedal 150 for sensing force applied by human driver 132, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

Controller 12 may also receive input from human/machine interface 11. A request to start the engine or vehicle may be generated via a human and input to the human/machine interface 11. The human/machine interface may be a touch screen display, pushbutton, key switch or other known device. Controller 12 may also automatically start engine 10 in response to vehicle and engine operating conditions. Automatic engine starting may include starting engine 10 without input from human 132 to a device that is dedicated to receive input from human 132 for the sole purpose of starting and/or stopping rotation of engine 10 (e.g., a key switch or pushbutton). For example, engine 10 may be automatically stopped in response to driver demand torque being less than a threshold and vehicle speed being less than a threshold.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2:
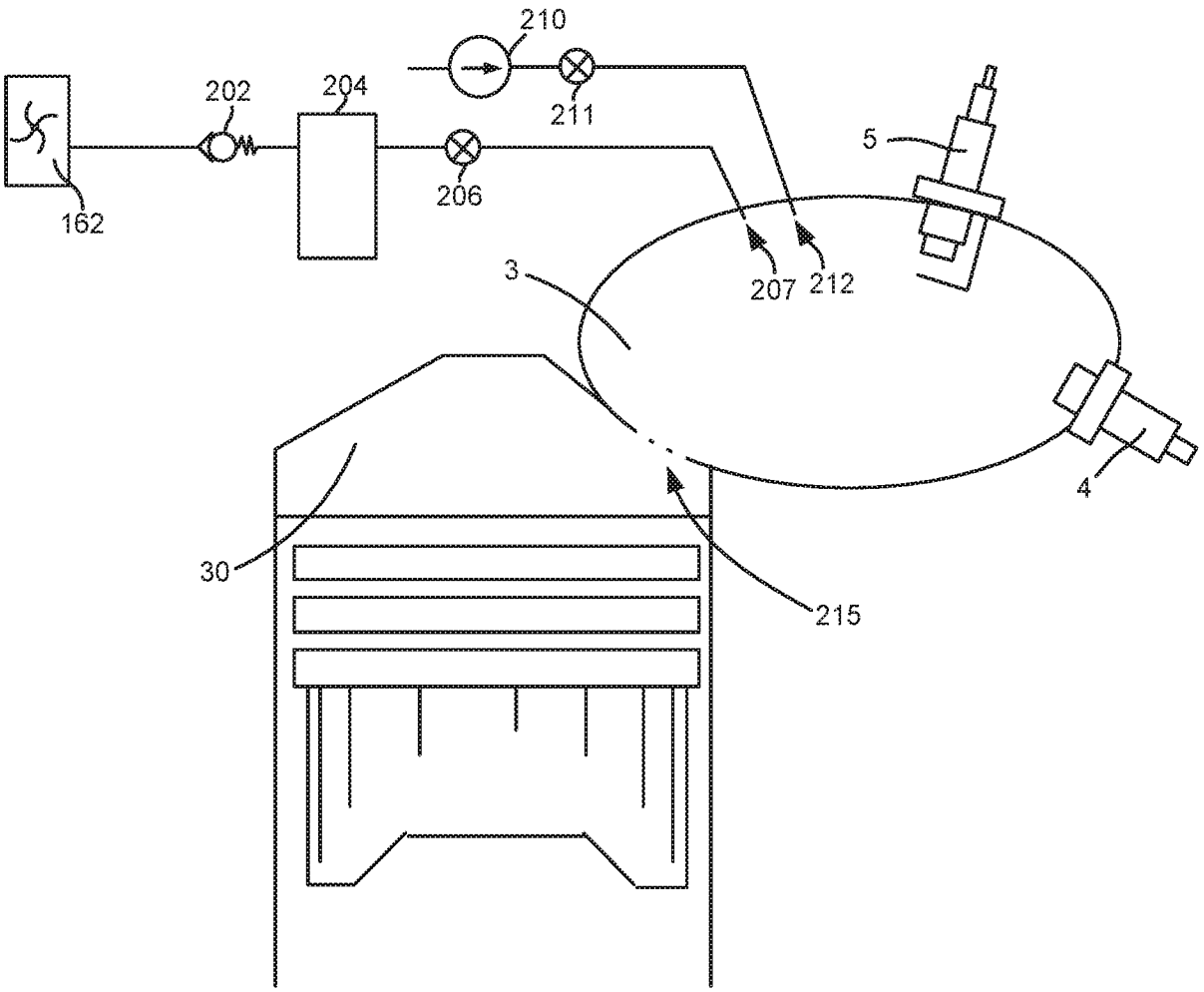
FIG. 2 is a schematic diagram of a cylinder and a pre-chamber that is coupled to the cylinder.
Figure 3:
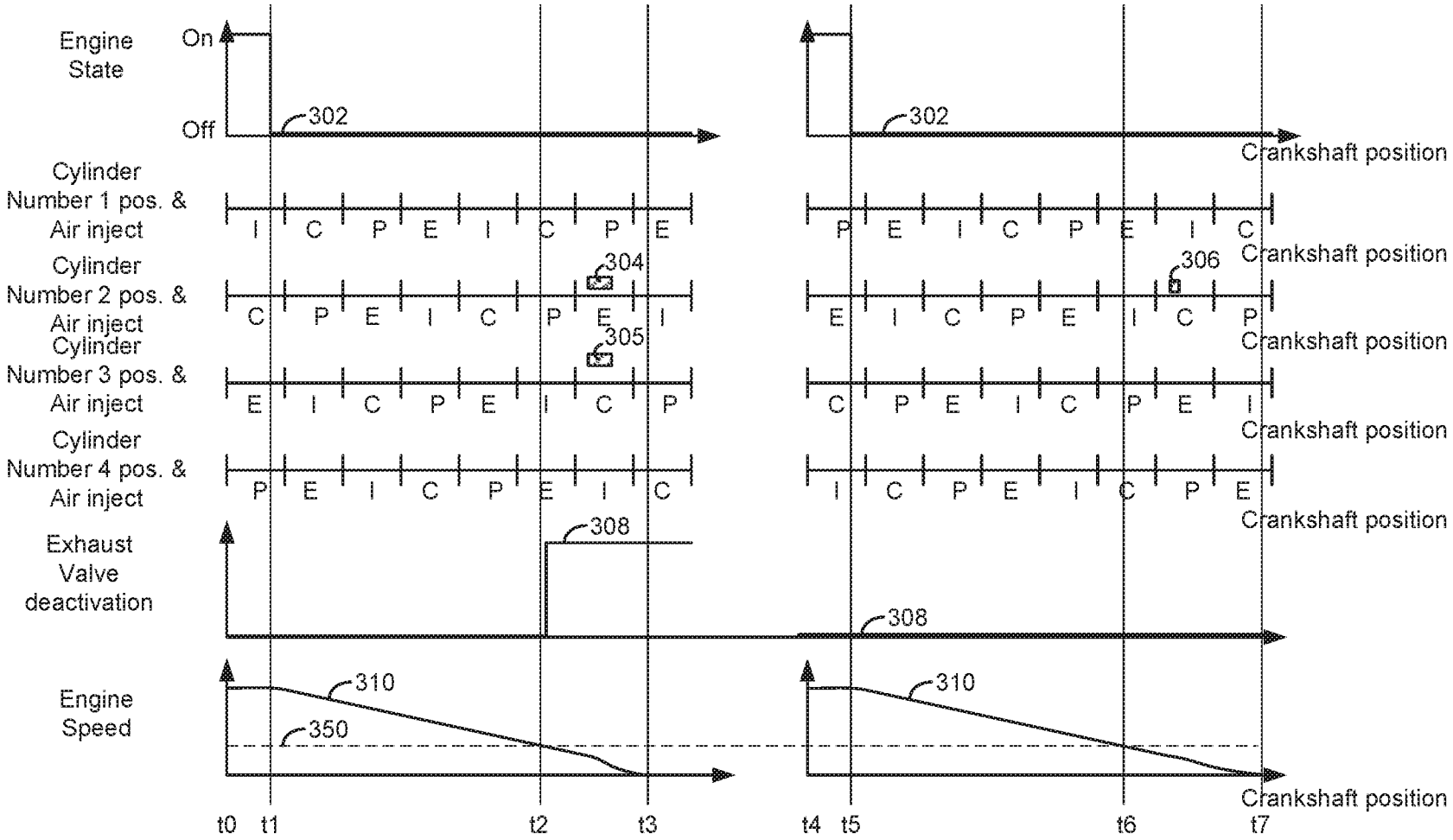
FIG. 3 shows to example engine stopping sequences.

FIG. 2 is a detailed view of pre-chamber 3 and its accompanying components. Pre-chamber 3 includes fuel injector 4 for injecting petrol and a spark plug 5 for generating a spark and combusting an air-fuel mixture within pre-chamber 3. Pressurized air may be supplied to pre-chamber 3 via compressor 162 and reservoir 204. In particular, pressurized air may flow to reservoir 204 via check valve 202. Check valve 202 allows air to flow from compressor 162 to reservoir 204 and it prevents air flow from reservoir 204 to compressor 162. Compressed air may flow from reservoir 204 to air inlet 207 in pre-chamber 3 when pre-chamber air flow control valve 206 is open. Compressed air is prevented from flowing to air inlet 207 when pre-chamber air flow control valve 206 is closed. Alternatively, air pump 210 may supply air to pre-chamber 3 when air pump 210 is activated and when pre-chamber air flow control valve 211 is open. Controller 12 shown in FIG. 1 may adjust the operating states of compressor 162, valves 206, 211, pump 210, spark plug 5, and fuel injector 4.

Pre-chamber also includes jets or ports 215 that may allow gases and flame fronts to pass from pre-chamber 3 to cylinder 30. Gases that may flow into cylinder 30 may include air and combustion by-products.

Thus, the system of FIGS. 1 and 2 provides for a system, comprising: an engine; a cylinder; a pre-chamber coupled to the cylinder, the pre-chamber including a spark plug, a fuel injector, and an air inlet; and a controller including executable instructions stored in non-transitory memory that cause the controller to inject air into the pre-chamber while the cylinder is on an compression stroke in response to a request to stop the engine. The system further comprises a second cylinder including a second pre-chamber coupled to the second cylinder. The system further comprises additional instructions to inject air to the second pre-chamber during an exhaust stroke of the second cylinder. The system further comprises additional instructions to deactivate an exhaust valve of the second cylinder in a closed position in response to a request to stop the engine. The system further comprises additional instructions to adjust an amount of the air injected into the pre-chamber in response to at least one of engine speed, intake manifold pressure, and engine temperature. The system includes where the engine temperature is engine oil temperature.

Referring now to FIG. 3, two example engine stopping sequences are shown. The stopping sequences of FIG. 3 may be generated via the system of FIGS. 1 and 2 in cooperation with the method of FIG. 4. Vertical lines at times t0-t6 represent times of interest during the sequences. The plots in FIG. 3 are time aligned and occur at the same time. FIG. 3 depicts a starting sequence for four engine cylinders; however, the approach may also be applied to engine's having a fewer or a greater number of cylinders.

The first plot from the top of FIG. 3 is a plot of engine operating state versus time. The vertical axis represents engine operating state and the engine is requested to start or is running (e.g., rotate and combust fuel and air) when trace 302 is at a higher level near the vertical axis arrow. The engine is requested to stop or is stopped (e.g., not rotating and combusting air and fuel) when trace 302 is at a lower level near the horizontal axis. The horizontal axis represents engine crankshaft position and engine crankshaft position rotates from the left side of the plot to the right side of the plot. Trace 302 represents the engine operating state.

The second plot from the top of FIG. 3 is a plot of the air injection into the pre-chamber of cylinder number one versus cylinder number one crankshaft position. Injections of air into the pre-chamber of cylinder number one may be shown as indicated by a bar at 304. The length of the bar may be indicative of air injection duration. For example, the longer the bar the more air that is injected into the cylinder's pre-chamber. Although no air injection is shown into the pre-chambers of cylinders numbered one and four in these examples, these cylinders may also receive air via their respective pre-chambers in other examples. The horizontal axis represents crankshaft position relative to cylinder number one stroke and cylinder number one strokes are identified as I (intake stroke), C (compression stroke), P (expansion or power stroke), and E (exhaust stroke) and the engine rotates from the left side of the plot to the right side of the plot.

The third plot from the top of FIG. 3 is a plot of the air injection into the pre-chamber of cylinder number two versus cylinder number two crankshaft position. Injections of air into the pre-chamber of cylinder number two may be shown as indicated by a bar at 304. The horizontal axis represents crankshaft position relative to cylinder number two stroke and cylinder number two strokes are identified as I (intake stroke), C (compression stroke), P (expansion or power stroke), and E (exhaust stroke) and the engine rotates from the left side of the plot to the right side of the plot.

The fourth plot from the top of FIG. 3 is a plot of the air injection into the pre-chamber of cylinder number three versus cylinder number three crankshaft position. Injections of air into the pre-chamber of cylinder number three may be shown as indicated by a bar at 305. The horizontal axis represents crankshaft position relative to cylinder number two stroke and cylinder number three strokes are identified as I (intake stroke), C (compression stroke), P (expansion or power stroke), and E (exhaust stroke) and the engine rotates from the left side of the plot to the right side of the plot.

The fifth plot from the top of FIG. 3 is a plot of the air injection into the pre-chamber of cylinder number four versus cylinder number two crankshaft position. Injections of air into the pre-chamber of cylinder number four may be shown as indicated by a bar at 304. The horizontal axis represents crankshaft position relative to cylinder number four stroke and cylinder number four strokes are identified as I (intake stroke), C (compression stroke), P (expansion or power stroke), and E (exhaust stroke) and the engine rotates from the left side of the plot to the right side of the plot.

The sixth plot from the top of FIG. 3 is a plot of a command to deactivate and hold exhaust valves of one or more of the engine's cylinders closed during cycles of the engine. The vertical axis represents the state of the exhaust valve deactivation request and the exhaust valves are requested to be deactivated when trace 308 is at a high level near the vertical axis arrow. The exhaust valves are not requested to be deactivated when trace 308 is at a lower level near the horizontal axis. The horizontal axis represents engine crankshaft position and engine crankshaft rotates from the left side of the plot to the right side of the plot. Trace 308 represents the state of the exhaust valve deactivation request.

The seventh plot from the top of FIG. 3 is a plot of engine speed versus engine crankshaft position. The vertical axis represents engine speed and engine speed increases in the direction of the vertical axis arrow. The engine speed is zero at the level of the horizontal axis. The horizontal axis represents engine crankshaft position and engine crankshaft rotates from the left side of the plot to the right side of the plot. Trace 310 represents engine speed. Horizontal line 350 represents an engine speed at which air injection to one or more engine cylinders is determined to stop the engine at a desired crankshaft angle.

At time t0, the engine state is combusting fuel and rotating. The engine speed is relatively high and air is not being injected into pre-chambers of engine cylinders. However, in other examples, air may be injected to pre-chambers when the engine is running.

At time t1, an engine stop is requested and fuel delivery to engine cylinders is suspended (not shown). The engine speed begins to fall as the engine ceases to generate positive torque. Air is not injected to pre-chambers of engine cylinders.

At time t2, engine speed is reduced to less than a threshold speed. Based on the engine's present position when engine speed falls below threshold speed 350, it may be determined how air is injected to the pre-chambers of the engine's cylinders. The pre-chamber injection strategy may be a function of engine speed, engine temperature, engine intake manifold pressure at the time engine speed is less than threshold speed 350, and desired or requested engine stopping position. In this example, it is judged desirable to stop the engine during an expansion stroke of cylinder number three and within 90 crankshaft degrees of top-dead-center expansion stroke of cylinder number three. The engine may be requested to stop at this or a similar position when the engine may be expected to be direct started without rocking the engine at starting (e.g., combusting fuel in a cylinder that is stopped in its compression stroke causing reverse engine rotation (clockwise) followed by combusting fuel in a cylinder that is on its expansion stroke causing forward engine rotation (counter-clockwise)). It is also judged to deactivate one or more exhaust valves so that the engine may stop at this position if the hardware exits on the engine to deactivate the exhaust valves. Therefore, the exhaust valves of one or more cylinders are deactivated and held in a closed position as the engine rotates shortly after time t2. This may allow air to be injected during an exhaust stroke of an engine cylinder without the injected air being allowed to be pushed out of the cylinder as the engine reaches top-dead-center exhaust stroke. Alternatively, air may also be injected into an engine with a conventional valve train in a cylinder that is on its compression stroke. This may slow the engine enough to stop the engine on an expansion stroke of the cylinder that will be used to direct start the engine. One skilled in the art will recognize that air may be injected in a combination of cylinders that are on their compression or expansion strokes at opportunistic times to the balance rotational forces about the crankshaft and to stop the engine in the desired stopping position to enable direct starting. Thus, air may be injected into a plurality of pre-chambers of a plurality of cylinders to reduce torque pulsations of the crankshaft and the actual total number of cylinders that air is injected into may be a function of crankshaft speed and/or engine noise or vibration. In this way, the torque to rotate the engine may be increased so that the engine stops rotating sooner than if air was not injected to a second cylinder. Air is injected to cylinder numbers two and three at 304 and 305 as indicated. The engine stops rotating at time t3.

A second engine stopping sequence is shown beginning at time t4. At time t4, the engine state is combusting fuel and rotating. The engine speed is relatively high and air is not being injected into pre-chambers of engine cylinders. However, in other examples, air may be injected to pre-chambers when the engine is running.

At time t5, an engine stop is requested and fuel delivery to engine cylinders is suspended (not shown). The engine speed begins to fall as the engine ceases to generate positive torque. Air is not injected to pre-chambers of engine cylinders and exhaust valves of the cylinders are not deactivated.

At time t6, engine speed is reduced to less than a threshold speed. Based on the engine's present position when engine speed falls below threshold speed 350, it may be determined how air is injected to the pre-chambers of the engine's cylinders. In this example, it is judged desirable to stop the engine during a compression stroke of cylinder number four and at least 90 crankshaft degrees before top-dead-center compression stroke of cylinder number four so that the engine may be directly started via rocking as previously described. It is also judged to not deactivate one or more exhaust valves so that the engine may rotate further than if a larger amount of air were injected into the pre-chambers and cylinders. Air is injected to only cylinder number two and at 306 as indicated. The engine stops rotating at time t7.

In this way, air may be injected into pre-chambers of cylinders to improve engine stopping position control. Further, although not shown, air may be injected to several engine cylinders as the engine rotates over a plurality of engine cycles, if desired. Such operation may be provided if it is desired to stop engine rotation sooner.

Figure 4:
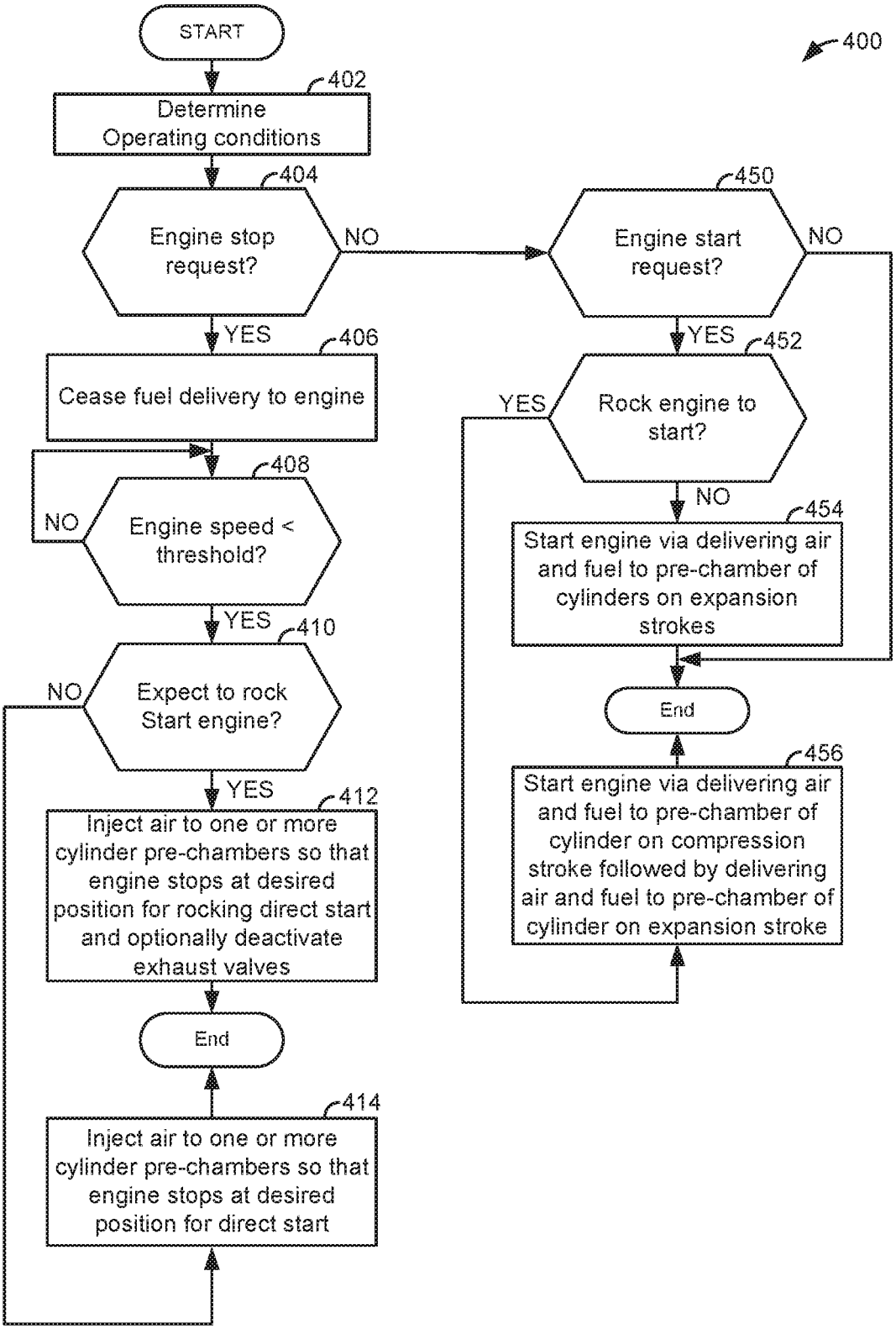
FIG. 4 shows a flowchart of a method for stopping and starting an engine.

Referring now to FIG. 4, a flow chart of a method for starting and stopping an engine is shown. The method of FIG. 4 may be incorporated into and may cooperate with the system of FIGS. 1 and 2. Further, at least portions of the method of FIG. 4 may be incorporated as executable instructions stored in non-transitory memory while other portions of the method may be performed via a controller transforming operating states of devices and actuators in the physical world.

At 402, method 400 determines operation conditions. Operating conditions may include but are not limited to ambient temperature, engine temperature, engine speed, barometric pressure, engine intake manifold temperature, engine oil temperature, and driver demand torque. The engine operating conditions may be determined via the various sensors described herein. Method 400 proceeds to 404.

At 404, method 400 judges if an engine stop is requested. An engine stop may be requested via a human providing input to a controller, via a controller, or via a signal from a remote device (e.g., key fob). If method 400 determines that there is an engine stop request, the answer is yes and method 400 proceeds to 406. Otherwise, the answer is no and method 400 proceeds to 450.

At 450, method 400 judges if an engine direct start is requested. An engine start may be requested via a human providing input to a controller, via a controller, or via a signal from a remote device (e.g., key fob). Further, a direct start may be requested to automatically start the engine. A direct start includes injecting fuel to a cylinder when the engine is stopped and not rotating so that the fuel may be combusted in the cylinder to start or aid in rotation of the engine. In some examples, an electric machine (e.g., a starter or an integrated starter/generator) may also be activated to help rotate the engine when the engine is being direct started. In particular, the electric machine may provide torque to rotate the engine once fuel in an engine cylinder that is on an expansion stroke while the engine is stopped is combusted. If method 400 determines that there is an engine direct start request, the answer is yes and method 400 proceeds to 452. Otherwise, the answer is no and method 400 proceeds to exit.

At 452, method 400 judges if it is desired to rock the engine during the direct start. Method 400 may judge to generate a rocking engine start in response to the engine's temperature and other factors. If method 400 judges that a rocking engine start is desired, then the answer is yes and method 400 proceeds to 456. Otherwise, the answer is no and method 400 proceeds to 454.

At 454, method 400 delivers air and fuel to the pre-chamber of a cylinder that is on its expansion stroke while the engine is stopped. Air delivery to the pre-chamber may be via a pump or via a compressor as shown in FIG. 2. If the air is delivered via a compressor, it may be stored in a reservoir and pressurized air stored in the reservoir may be released to the pre-chamber via opening a pre-chamber air flow control valve. If the air is delivered via a pump, the pump may be activated and a pre-chamber air flow control valve may be opened to allow the air into the pre-chamber. The fuel may be delivered to the pre-chamber via a pre-chamber fuel injector.

In some examples, fuel may be delivered to the cylinder via a fuel injector that protrudes into the cylinder (e.g., a direct fuel injector) when fuel is injected into the cylinder pre-chamber. The amount of fuel that may be injected may be a function of an amount of air that is stored in the cylinder while the engine is not rotating and the amount of air that is delivered into the cylinder via air flowing from the pre-chamber into the cylinder. If more than one engine cylinder is on its expansion stroke, fuel and air may be delivered to more than one cylinder. Method 400 proceeds to exit.

At 456, method 500 starts the engine by injecting fuel to a cylinder (e.g., via the pre-chamber and/or directly in the cylinder) that is stopped on its compression stroke and combusts the engine via the cylinder's spark plug. Combustion in this cylinder may initiate reverse engine rotation. Fuel is also injected to a cylinder that is on its expansion stroke when the engine was stopped. The fuel that was injected to the cylinder that is on its expansion stroke may be ignited after the fuel was ignited in the cylinder that was on its compression stroke so that the engine begins to rotate in a forward direction. Spark and fuel are then delivered to other engine cylinders to increase engine speed.

At 406, method 400 ceases to inject fuel into the cylinder pre-chamber. In addition, the engine's throttle may be fully closed. Method 400 proceeds to 408.

At 408, method 400 judges if engine speed is less than a threshold speed. If so, the answer is yes and method 400 proceeds to 410. If not, method 400 returns to 408.

At 410, method 400 judges if a direct rocking engine start is expected for a next subsequent engine start. In one example, method 400 may judge that engine rocking may be desired if ambient air temperature is less than a threshold temperature. If method 400 judges that a direct rocking engine start is expected for the next engine start, the answer is yes and method 400 proceeds to 412. Otherwise, the answer is no and method 400 proceeds to 414.

At 412, method 400 injects air to one or more cylinders to reduce engine speed and control the engine's stopping position. In one example, method 400 injects an amount of air into engine cylinders via injecting air into the cylinder's pre-chamber that is a function of engine speed, engine oil temperature, intake manifold pressure, and desired engine stopping position. The desired engine stopping position for a rocking engine start may be an engine position of a cylinder where the cylinder's piston is less than a predetermined number of crankshaft degrees before top-dead-center compression stroke of the cylinder (e.g., preferably within 45 crankshaft degrees of top-dead-center compression stroke of the cylinder).

The air may be injected into one or more engine cylinder pre-chambers such that the air flows into the pre-chamber and the cylinder. Further, air may be injected to more than one cylinder and air may be injected to cylinders over several engine cycles. Further still, different amounts of air may be injected to the engine cylinders each engine cycle to improve engine position control. For example, air may be injected to cylinder number two and cylinder number three as shown in FIG. 3. Air may also be injected to cylinder number two and/or other cylinders more than one time after an engine stop request. Method 400 proceeds to exit.

At 414, method 400 injects air to one or more cylinders to reduce engine speed and control the engine's stopping position. In one example, method 400 injects an amount of air into engine cylinders via injecting air into the cylinder's pre-chamber that is a function of engine speed, engine oil temperature, intake manifold pressure, and desired engine stopping position. The desired engine stopping position for a not rocking engine start may be an engine position of a cylinder where the cylinder's piston is less than a predetermined number of crankshaft degrees after top-dead-center expansion stroke of the cylinder (e.g., preferably within 60 crankshaft degrees of top-dead-center expansion stroke of the cylinder for a six cylinder engine).

The air may be injected into one or more engine cylinder pre-chambers such that the air flows into the pre-chamber and the cylinder. Further, air may be injected to more than one cylinder and air may be injected to cylinders over several engine cycles. In addition, different amounts of air may be injected to the engine cylinders each engine cycle to improve engine position control. For example, air may be injected to cylinder number two and cylinder number three as shown in FIG. 3. Air may also be injected to cylinder number two and/or other cylinders more than one time after an engine stop request. In addition, the timing or crankshaft angle at which the air is injected may be adjusted to control engine stopping position. For example, air may be injected to a pre-chamber of a cylinder that has its intake and exhaust valves closed at top-dead-center of a cylinder stroke as shown in the second engine stop illustrated in FIG. 3. Method 400 proceeds to exit.

In this way, an engine may be stopped at a desired or requested engine stopping position. By injecting air directly into a pre-chamber that is in pneumatic communication with a cylinder, it may be possible stop the engine more repeatedly at a desired or requested engine stopping position.

Thus, the method of FIG. 4 provides for a method for operating an engine, comprising: injecting air into a pre-chamber of a cylinder via a controller in response to a request to stop rotation of the engine. The method includes where the air is injected during a compression stroke of the cylinder. The method includes where the air is injected after intake valve closing and before exhaust valve opening during a cycle of the cylinder. The method further comprises deactivating an exhaust valve of a second cylinder in a closed position in response to the request to stop engine rotation. The method further comprises injecting air into a second pre-chamber of the second cylinder. The method includes where the air is injected into the second pre-chamber of the cylinder during an exhaust stroke of the second cylinder. The method includes where injecting air into the pre-chamber of the cylinder includes adjusting an amount of air injected in response to at least one of engine speed, intake manifold pressure, and an engine temperature. The method includes where the engine temperature is an engine oil temperature. The method further comprises closing a throttle of the engine in response to the engine stop request.

The method of FIG. 4 also provides for an engine operating method, comprising: injecting air into a pre-chamber of a cylinder and into the cylinder via the pre-chamber in response to an engine stop request, where injecting air into the pre-chamber includes adjusting an amount of air injected to the cylinder based on stopping an engine at a crankshaft position that facilitates a rocking direct engine start. The method includes where the rocking direct engine start includes initiating combustion in a cylinder of the engine that is on a compression stroke while the engine is not rotating. The method includes where the rocking direct engine start includes initiating combustion in a cylinder of the engine that is on an expansion stroke. The method includes where an amount of the air injected into the pre-chamber is based on an engine temperature. The method includes where the rocking direct start includes rotating the engine clockwise and counter-clockwise.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, I3, I4, I5, 16, V6, V8, V10, and V12 engines operating in natural gas, gasoline, or alternative fuel configurations could use the present description to advantage.

The invention claimed is:

1. A method for operating an engine, comprising:

injecting air into a pre-chamber of a cylinder via a controller in response to a request to stop rotation of the engine.

2. The method of claim 1, where the air is injected during a compression stroke of the cylinder, and further comprising injecting air into a plurality of pre-chambers of a plurality of cylinders to reduce torque pulsations of a crankshaft in response to crankshaft speed.

3. The method of claim 1, where the air is injected after intake valve closing and before exhaust valve opening during a cycle of the cylinder.

4. The method of claim 1, further comprising deactivating an exhaust valve of a second cylinder in a closed position in response to the request to stop engine rotation.

5. The method of claim 4, further comprising injecting air into a second pre-chamber of the second cylinder.

6. The method of claim 5, where the air is injected into the second pre-chamber of the cylinder during an exhaust stroke of the second cylinder.

7. The method of claim 1, where injecting air into the pre-chamber of the cylinder includes adjusting an amount of air injected in response to at least one of engine speed, intake manifold pressure, and an engine temperature.

8. The method of claim 7, where the engine temperature is an engine oil temperature.

9. The method of claim 1, further comprising closing a throttle of the engine in response to the engine stop request.

10. A system, comprising:

an engine;

a cylinder;

a pre-chamber coupled to the cylinder, the pre-chamber including a spark plug, a fuel injector, and an air inlet; and a controller including executable instructions stored in non-transitory memory that cause the controller to inject air into the pre-chamber while the cylinder is on a compression stroke in response to a request to stop the engine.

11. The system of claim 10, further comprising a second cylinder including a second pre-chamber coupled to the second cylinder.

12. The system of claim 11, further comprising additional instructions to inject air to the second pre-chamber during an exhaust stroke of the second cylinder.

13. The system of claim 12, further comprising additional instructions to deactivate an exhaust valve of the second cylinder in a closed position in response to the request to stop the engine.

14. The system of claim 10, further comprising additional instructions to adjust an amount of the air injected into the pre-chamber in response to at least one of engine speed, intake manifold pressure, and engine temperature.

15. The system of claim 14, where the engine temperature is engine oil temperature.

16. An engine operating method, comprising:

injecting air into a pre-chamber of a cylinder and into the cylinder via the pre-chamber in response to an engine stop request, where injecting air into the pre-chamber includes adjusting an amount of air injected to the cylinder based on stopping an engine at a crankshaft position that facilitates a rocking direct engine start.

17. The method of claim 16, where the rocking direct engine start includes initiating combustion in a cylinder of the engine that is on a compression stroke while the engine is not rotating.

18. The method of claim 17, where the rocking direct engine start includes initiating combustion in a cylinder of the engine that is on an expansion stroke.

19. The method of claim 16, where an amount of the air injected into the pre-chamber is based on an engine temperature.

20. The method of claim 16, where the rocking direct start includes rotating the engine clockwise and counter-clockwise.

* * * * *